United States Patent [19]

Diehn et al.

[11] 3,934,372

[45] Jan. 27, 1976

[54] PORTABLE UPBLAST CLEANING HEAD

[75] Inventors: Philip H. Diehn, Mishawaka; John C. Bergh, Elkhart, both of Ind.

[73] Assignee: Wheelabrator-Frye, Inc., Mishawaka, Ind.

[22] Filed: Oct. 10, 1974

[21] Appl. No.: 513,633

[52] U.S. Cl. ..... 51/8 SR; 51/9 M

[51] Int. Cl.[2] ..... B24C 3/06

[58] Field of Search ..... 51/9 R, 9 M, 8 BR; 114/222, 224

[56] References Cited

UNITED STATES PATENTS

| | | | |
|---|---|---|---|
| 3,034,262 | 5/1962 | Pawlson | 51/9 M |
| 3,262,228 | 7/1966 | Schenck | 51/9 M |
| 3,566,543 | 3/1971 | Fogle | 51/9 M |
| 3,788,010 | 1/1974 | Goff | 51/9 M |
| 3,827,188 | 8/1974 | Fuma | 51/9 M X |
| 3,864,876 | 2/1975 | Diehn | 51/9 M |

*Primary Examiner*—Donald G. Kelly
*Attorney, Agent, or Firm*—McDougall, Hersh & Scott

[57] ABSTRACT

This invention relates to a portable upblast cleaning head which makes use of an airless centrifugal blasting wheel for throwing particulate in an upwardly direction against the underside of a horizontally disposed surface. The head includes means for effecting a sealing relation with the surface to be treated and for recovery and air wash separation of the blasting particulate from deposits and residue which are removed by the blasting process. The separating means is contained directly in the blasting head so that a completely portable and self-contained unit capable of recycling the particulate is obtained.

18 Claims, 3 Drawing Figures

PORTABLE UPBLAST CLEANING HEAD

BACKGROUND OF THE INVENTION

This invention relates to a portable upblast cleaning device. More particularly, it relates to a device of the type which utilizes one or more airless centrifugal blasting wheels for throwing particulate such as steel shot, grit or other abrasives against a surface. In particular, the present invention relates to a class of cleaning devices which are adapted for cleaning the underside of a horizontally disposed surface as, for example, the outside hull of a large ship. The device utilizes one or more airless centrifugal blasting wheels for throwing abrasive in an upwardly direction against the horizontally disposed surface. Sealing engagement with the surface is maintained by a flexible seal disposed around the blast area. The seal is maintained in contact with the blast area by various movable frame arrangements which are known in the art. After striking the surface, it is desirable to reclaim and reuse the abrasive.

In previous blast heads of the type described, there was a particular problem in recycling the abrasive due to the contamination and buildup of foreign particles in the device. As the buildup occurs, these particles mix with the abrasive and get recycled through the blasting device reducing its effectiveness and tending to clog or otherwise impair the efficiency of the device.

Another problem commonly experienced in devices of this class is the heat buildup about the blasting area due to the dissipation of kinetic energy of the particulate against the surface being treated. This heat buildup aggravates the contamination problem causing binding of refuse of abrasive. One way to solve the problem of contaminant buildup is to pass the abrasive through a separator as, for example, an air wash separator to remove the contaminant. Previous attempts have utilized a separator which is located at a remote point from the cleaning head. Accordingly, the abrasive must be transported by a conveyer system from the blast head to the remote separator and back again before reuse. This arrangement is not entirely satisfactory and tends to limit the portability and versatility of the unit.

It is accordingly an object of the present invention to provide an abrasive cleaning device which recycles spent abrasive for reuse.

It is another object of the present invention to provide a portable blast head which prevents buildup of foreign matter in the returned abrasive to prevent gumming and sticking of the apparatus.

It is another object of the present invention to provide an air flow in the blast area of the device to maintain the temperature in the blast area at a selected level.

It is a further object of the present invention to provide a portable blast head having an air flow in the blast chamber to enhance the conveying of abrasive towards the recycling section.

It is another object of the present invention to provide a device which permits rapid access to the blast wheel and impellor so that jams and buildup of foreign matter can be quickly cleared and the machine easily serviced.

It is a further object of the invention to provide directly in the blast head itself a compact and efficient means of separating debris and foreign material from the returning abrasive prior to its reuse.

It is yet another object of the present invention to provide an air wash separating device in a portable blast head for extracting debris and other contaminants from spent abrasive.

Other objects and advantages of the invention will be apparent from the concluding portion of the specification.

DETAILED DESCRIPTION

Figure 1:
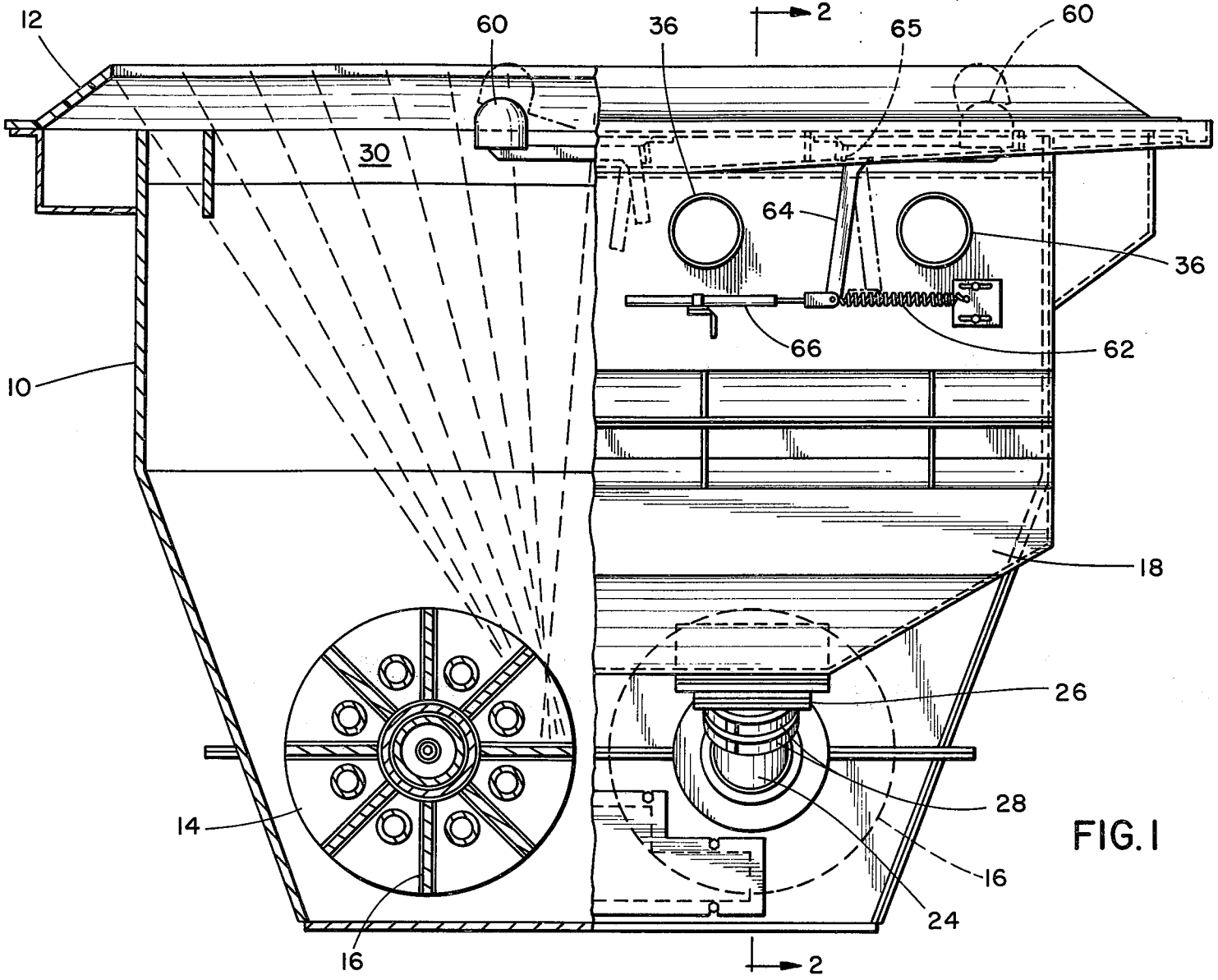
FIG. 1 is a side elevation of a portable upblast cleaner of the present invention having portions thereof cut away.
Figures 2, 3:
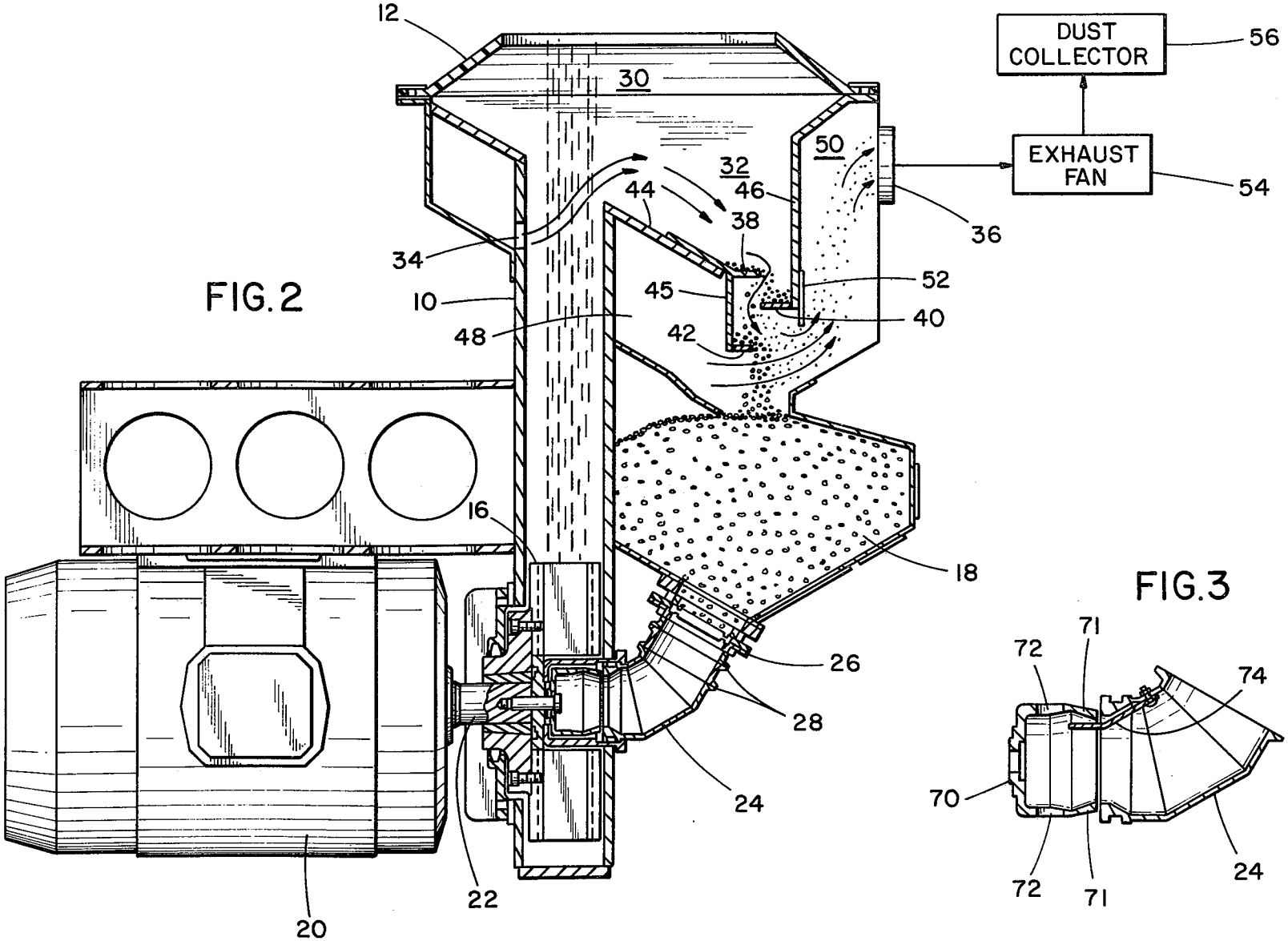
FIG. 2 is a sectional view along the lines 2—2 of FIG. 1 illustrating the internal arrangement of the upblast cleaner.
FIG. 3 is a sectional view of a blast wheel impellor illustrating a design modification.

Referring to FIGS. 1 and 2, a portable upblast cleaner is disclosed. The cleaner is provided in a housing 10, the upper end of which is open. Disposed about the open end of the housing is a flexible seal 12, preferably of polyurethane. When the device is in use the open end of the housing is pressed against a surface to be treated and the seal 12 prevents the escape of abrasive to the outside. Provided in the lower portion of the housing 10 is at least one and preferably two airless centrifugal blasting wheels 14 and 16. These wheels are well known in the art and are of the type manufactured by Wheelabrator-Frye Inc. of Mishawaka, Indiana. The blasting wheels receive abrasive from a storage supply hopper 18. High velocity rotation of the wheel is effective for throwing the particulate material upwardly in the housing 10 with sufficient kinetic energy to effect cleaning, scouring or abrading of a surface which is subjected to the blast.

As indicated in FIG. 2, the wheel 16 is driven by a motor 20 connected by a direct drive shaft 22. A similar drive arrangement is provided for the wheel 14. Wheel 16 receives particulate such as steel shot, grit or other abrasive materials from the supply hopper 18 via a flanged conduit 24. The flow rate from the supply hopper to the wheel is controlled by a slide valve 26 which may be hydraulically operated. The flange conduit is assembled by use of one or more connector rings 28 which permit quick and simple disassembly of the conduit to permit access to the interior of the wheel and the supply hopper should such be necessary to clear a jam or for other servicing purposes. The motor 20 drives the wheel 16 at rotational velocities on the order of 3600 revolutions per minute causing the abrasive fed to the wheel to be hurled upwardly through the housing 10 to the blast area 30.

As the abrasive thrown from the wheels 14 and 16 reaches the blast chamber, it impinges upon the surface to be treated which is encircled by the seal 12. The high kinetic energy of the blasting media is effective for treating the surface. For example, cleaning, abraiding, scouring and similar procedures can all be accomplished utilizing the portable upblast device of the present invention by proper selection of velocities, abrasives and rate of travel.

The abrasive striking the surface dislodges particles therefrom which may be rust, paint and other deposits or residues. Both the spent abrasive and these residues fall downwardly from the surface and are collected in a rebound chamber 32 located directly beneath the blasting area 30. In order to assure that most of the material rebounding from the surface passes into the rebound chamber, it is enlarged to cover a substantial portion of the blast area. A small amount of material will fall back to the wheels but is again propelled therefrom.

A further provision to insure that most of the abrasive and residue pass into the rebound chamber 32 is the use of a cross air flow. Air is drawn into the head through a series of horizontally disposed ports 34 in the housing structure. The air enters through the ports 34 and flows across the blast area 30 and down into the rebound chamber.

This ventilating air serves the dual purpose of enhancing the amount of particulate which falls into the rebound chamber and also cooling the blast area to prevent heat buildup due to the kinetic energy dissipated by the blasting media striking the surface under treatment. Heat buildup shortens the life of the seals 12 and causes the residue material dislodged from the surface to coalesce, melt and otherwise bind and coat the abrasive.

As thus far described, the device of the present invention is effective for throwing abrasive at high kinetic energies against the underside of a horizontal surface to be cleaned. Abrasive strikes the surface dislodging particles therefrom and both the particles and abrasive fall from the blast area 30 into a rebound chamber 32 due to the effects of the air flow across the blast area and the configuration of the rebound chamber.

A significant problem in the utilization of devices of the present type is the tendency of the refuse removed from the treated surface to become intermingled with the abrasive or to coat it such that when the abrasive is reused, there is a buildup of this material on the parts of the device causing reduced efficiency and operation. For example, when paint is being removed by the device, the paint chips tend to build up on the blasting wheel impellors, causing a reduction in flow rate of abrasive to the wheel and ultimately causing a loss of cleaning effectiveness.

In order to avoid this operating problem, it is desirable to effect a separation of the abrasive from the deleterious material prior to permitting the abrasive to be reused. In prior art devices, this separation was either omitted or accomplished by use of a system whereby the spent abrasive was passed out of the portable cleaning head to a separate unit which effected separation and then conveyed the abrasive back to the portable cleaning head for reuse.

According to the present invention, an air wash type separator is contained in the portable blasting head of effecting separation of the abrasive from the debris as it passes downwardly from the rebound chamber 32 to the storage hopper 18. The separator section of the invention includes a set of horizontally extending ledges 38, 40 and 42, ledges 38 and 42 being attached to a sloped portion 44 of the rebound chamber structure. The ledge 40 is attached to the opposite side 46 of the chamber structure. Ledges 38 and 42 are spatially adjustable along a side wall 45 so that the labyrinth configuration created by the three ledges can be varied as desired. The abrasive and debris which rebound into the chamber 32 have lost most of their kinetic energy and begin falling through the ledges. The horizontally extending surfaces of the ledges accumulate abrasive thereon until the overflow point is reached. Additional abrasive entering the rebound chamber impacts or rolls over the abrasive piles, further dissipating any residual kinetic energy in the abrasive and residue prior to its entry into the separator. Spatial adjustment of the ledges 38 and 42 insure that the rebounding abrasive and residue cannot pass through the labyrinth and enter the separator without first being brought substantially to rest.

Due to this arrangement, the returning abrasive and residue fall from the lowest ledge 42 into the separator in a state of gravity-free fall. This creates an evenly distributed uniform curtain of falling abrasive and residue. An even curtain of falling abrasive is precisely the condition required to effect an air wash separation of the lighter particles from the heavier abrasive. Stated more succinctly, the debris removed from the surface under treatment will generally consist of paint particles, rust chips and the like of significantly less density than the abrasive particles which are generally steel shot, grit or other dense material. It is therefore possible to separate the materials by use of an air wash separation technique.

In the present invention a cross flow of air enters the blasting head under suction through an inlet plenum 48. The air flow traverses a horizontal path from the plenum 48 across the falling curtain of abrasive and debris to one or more exhaust openings 36 at the top of an exhaust plenum 50. This cross flow of air acts on the free falling curtain of material to propel the finer and less dense particles out the exhausts while permitting the heavier abrasive particles to fall into the storage hopper 18. The distance of abrasive free-fall, the size of the air slots and the air velocity may be varied as necessary to obtain an optimum separation of the constituent components of the falling column. In particular, an adjustable baffle plate 52 controls the size of the opening to the exhaust plenum 50 to restrict the air flow as necessary.

The separated abrasive passes downwardly into the storage hopper 18 for reuse. The storage hopper normally contains sufficient abrasive to feed both throwing wheels with an additional amount present to make up for leakage and other losses. When the abrasive passes from the storage hopper through the flange pipe 24 and back to the wheel, the abrasive cycle is then complete.

The separator air flow and the debris entrained thereon pass outwardly through exhausts 36 to a dust collector 56 under suction from an exhaust fan 54 which may be separately located from the head. Since the exhaust fan and dust collector are conventional they are indicated only by boxes in FIG. 2.

Referring again to FIG. 1, a portion of a conventional positioning device adapted to be used with the upblast cleaning head of the present invention is illustrated. As stated previously, it is necessary for the device to be in sealing engagement with the surface to be treated. This sealing engagement is accomplished by pressing the top of the device into contact with the surface. The pressing of the device against the surface to form the sealed blasting area is accomplished by means of a position sensing unit mounted on the upblast head, capable of controlling a hydraulic frame and positioning unit of conventional construction. This positioning sensor has particular use when the surface being treated has curved or irregular contours to maintain the sealing relationship.

The positioning sensor includes a plurality of contact shoes 60 which are normally biased by a tension spring 62 to a position extending slightly at or above the top of the seal 12. When the device is pressed against a surface to be treated, the contact shoes are pressed downwardly causing an actuator arm 64 to which they are attached, to rock about a pivot point 65 against the tension of spring 62. This rocking movement causes a slide potentiometer 66 connected to the actuator arm 64 to move a distance proportional to the amount that the contact shoe pivots the actuator arm. The potentiometer 66 is connected via conventional circuitry to produce an electrical signal proportional to the relative movement of each of the contact shoes 60. These electrical signals are utilized to control hydraulic control valves to operate the frame and positioning unit for the blast head.

If one of the contact shoes begins moving towards its initial position due to, for example, a curved contour in the treated surface, an electrical signal will be generated indicating that the frame assembly should move the blasting head into closer contact with the surface at that point in order to maintain a sealing relationship.

Since the servo system and the frame form no portion of the present invention, the details thereof are not illustrated. However, for reference purposes, the following source is referenced as an indication of the type of construction contemplated for mounting the present invention.

Referring now to FIG. 3, there is disclosed an additional element of the present invention which may be optionally employed when there is a serious problem with accumulation and buildup from the surface being treated. It has been found that when the device is utilized for sustained surface treatment as, for example, on the underside of a large oceangoing vessel, the rust, paint and other debris removed by the device tend to build up on the inside of the blast wheel impellors, in spite of the effective removal of a large portion of such debris by the air wash separator. This problem is ameliorated by the quick access to the blast wheels and the impeller interior through the quick release openings on the flange pipe 24. However, the addition of a scraper blade has been found to increase the period between necessary downtime servicing. The impeller 70 of the blast wheel has openings 72 therein for passing the abrasive received from the flange pipe 24 to the throwing vanes of the wheel. The buildup of residue occurs most heavily at the forward end 71 of the impellor where the abrasive is received from the flange pipe 24. A stationary scraper blade 74 is rigidly attached to the abrasive pipe 24. A small clearance is permitted between the scraper and the forward portion 71 of the impeller. When the residue buildup reaches a preselected amount, the residue will begin scraping or chafing against the scraper blade. The scraper blade is desirably formed of a hard material with a grained surface. Thus, when the buildup becomes excessive, it is reduced by being abraided against the scraper blade thereby to prevent further buildup. The clearance between the rotating impeller and the stationary scraper blade is adjustable, depending upon the application to which the device is being utilized. It has been found that a spacing of approximately 0.06 inches is effective for most purposes.

While we have shown and described embodiments of this invention in some detail, it will be understood that this description and illustrations are offered merely by way of example, and that the invention is to be limited in scope only by the appended claims.

We claim:

1. A portable upblast cleaning head for treating the underside of horizontally disposed surfaces comprising:

a. a housing open at its upper end and defining a generally vertical corridor;

b. at least one means mounted in the lower end of said housing for projecting particulate matter at high velocity toward said open upper end through said vertical corridor;

c. hopper means for supplying particulate to said projecting means;

d. means for effecting a sealing relationship between the open upper end of said housing and the surfaces being treated when said upper end is maintained in close proximity to said surface;

e. means for collecting spent particulate and debris resulting from said treating; and f. means in said housing for receiving said debris and particulate from said collecting means for substantially separating said debris from said particulate and returning said particulate to said hopper means for reuse.

2. The device of claim 1 further including means for exhausting said debris from said housing.

3. The device of claim 1 further including scraper means for limiting buildup of debris in said projecting means.

4. The device of claim 1 wherein said projecting means is an airless centrifugal blasting wheel including an impellor receiving said particulate from said hopper means.

5. The device according to claim 4 further including scraper means for limiting buildup of debris on said impellor.

6. The device of claim 1 wherein said hopper means includes:

a. storage hopper for holding said particulate;

b. a flanged pipe connecting said storage hopper to said projecting means; and c. valve means for controlling the flow rate of particulate through said flanged pipe.

7. The device according to claim 6 wherein said flanged pipe is connected to said storage hopper by quick-release connector rings to permit access to the storage hopper and pipe interior for servicing.

8. The device of claim 1 wherein said means for sealing includes a flexible sealing member disposed on said housing about said open end.

9. The device of claim 1 wherein said means for collecting includes:

a. a rebound chamber positioned beneath said open end into which most of said debris and particulate fall due to the force of gravity; and b. means for removing residual kinetic energy from said particulate and debris prior to its receipt by said separating means.

10. The device according to claim 9 wherein said means for removing includes a plurality of horizontally extending ledges spatially arranged to form a labyrinth passage for said particulate and debris from said collecting means to said separating means whereby said debris and particulate pass into said separating means in a state of gravity-free fall.

11. The device of claim 1 wherein said means for separating includes an air wash separator for separating said debris from said particulate.

12. The device according to claim 11 wherein said air wash separator includes:

a. an entry plenum and inlet in said housing permitting entry of air to the housing interior;

b. an exhaust plenum and outlet through which said air is exhausted from said housing; and c. means for creating a suction at said outlet whereby a continuous and constant stream of air is caused to enter said inlet, flow across said separator and out said outlet thereby to effect separation of said debris from said particulate.

13. The device according to claim 12 wherein said debris is entrained on said airstream and exhausted through said outlet and further including a dust collector to receive said entrained debris.

14. The device of claim 10 wherein said means for separating includes an air wash separator for separating said debris from said particulate.

15. The device of claim 10 wherein said air wash separator includes:

a. an entry plenum and inlet in said housing permitting entry of air to the housing interior;

b. an exhaust plenum and outlet through which said air is exhausted from said housing; and c. means for creating a suction at said outlet whereby a continuous and constant stream of air is caused to enter said inlet, flow across said separator and out said outlet thereby to effect separation of said debris from said particulate.

16. The device according to claim 15 wherein said debris in entrained on said airstream and exhausted through said outlet and further including a dust collector to receive said entrained debris.

17. The device according to claim 9 further including means for causing an air flow across said open end toward said collecting means to cool the blast area and increase the amount of particulate and debris received in said collecting means.

18. A portable upblast cleaning head for treating the underside of horizontally disposed surfaces comprising:

a. a housing open at its upper end and defining a generally vertical corridor;

b. at least one means mounted in the lower end of said housing for projecting particulate matter at high velocity toward said open upper end through said vertical corridor;

c. hopper means for supplying particulate to said projecting means;

d. means for effecting a sealing relationship between the open upper end of said housing and the surfaces being treated when said upper end is maintained in close proximity to said surface;

e. means for collecting spent particulate and debris resulting from said treating; and f. means in said housing for receiving said debris and particulate from said collecting means and returning them to said hopper means for further treatment.

* * * * *